US005201074A

United States Patent [19]

Dicker

[11] Patent Number: 5,201,074

[45] Date of Patent: Apr. 13, 1993

[54] EXERCISE SUIT WITH RESILIENT REINFORCING

[76] Inventor: Timothy P. Dicker, 11359 Dornfield, Lakeview Terrace, Calif.

[21] Appl. No.: 814,508

[22] Filed: Dec. 30, 1991

Related U.S. Application Data

[63] Continuation-in-part of Ser. No. 712,459, Jun. 10, 1991, Pat. No. 5,109,546.

[51] Int. Cl.[5] ..... A41D 13/00

[52] U.S. Cl. ..... 2/70; 2/69; 2/79; 2/227; 2/228; 2/239; 2/80; 482/105; 482/121

[58] Field of Search ..... 2/70, 69, 79, 227, 409, 2/228, 239, 80; 482/105, 121

[56] References Cited

U.S. PATENT DOCUMENTS

| | | | |
|---|---|---|---|
| 4,065,814 | 1/1978 | Fox | 2/227 |
| 4,384,369 | 5/1983 | Prince | 2/79 |
| 4,698,847 | 10/1987 | Yoshihara | 2/67 |
| 4,910,802 | 3/1990 | Malloy | 2/70 |
| 4,953,856 | 9/1990 | Fox, III | 2/69 |
| 5,046,194 | 9/1991 | Alaniz et al. | 2/69 |
| 5,109,546 | 5/1992 | Dicker | 2/70 |

*Primary Examiner*—Clifford D. Crowder
*Assistant Examiner*—Gloria Hale
*Attorney, Agent, or Firm*—Cislo & Thomas

[57] ABSTRACT

An exercise suit which has a pair of stretchable pants (20) and a pull-over top (44) with a lower-body reinforcing segment (38) attached, in the middle only, to the pants and an upper-body reinforcing collar (54) attached, in the middle only, to the top. A leg band (58) encircles the legs (24), and side bands (58) are affixed to the reinforcing collar. The leg bands (42) grip the wearer's feet, creating a continuous loop from the waist to the feet. Hook-and-loop tapes (40) allow the reinforcing segment (38) to be adjusted in tension around the wearer's waist and similarly adjustable knee pads (32) cover the knees in the pants legs (24). The resilience of the suit and the looped bands create a resistance to movement which provides exercise to the wearer's muscles during physical activity. Exercise short pants (60) are also provided which provide elongatable resistive bands (80, 82) which meet at the vertical midline of the back of the short pants and spiral downwardly across the buttocks and around the backs of the thighs of the wearer to end at the leg openings. In an alternative embodiment, exercise short pants (60') employ resistive bands (80', 82') reversed back-to-front in location on the short pants as well as a low-back panel (84) in the shape of an upright "V" attached by elastic at the vertical midline of the back of the shorts and having first and second hook-and-loop tabs (90, 92) at the free ends thereof which mate with tabs (94, 96) on the sides of the waistband to provide adjustable resistance to motion.

10 Claims, 4 Drawing Sheets

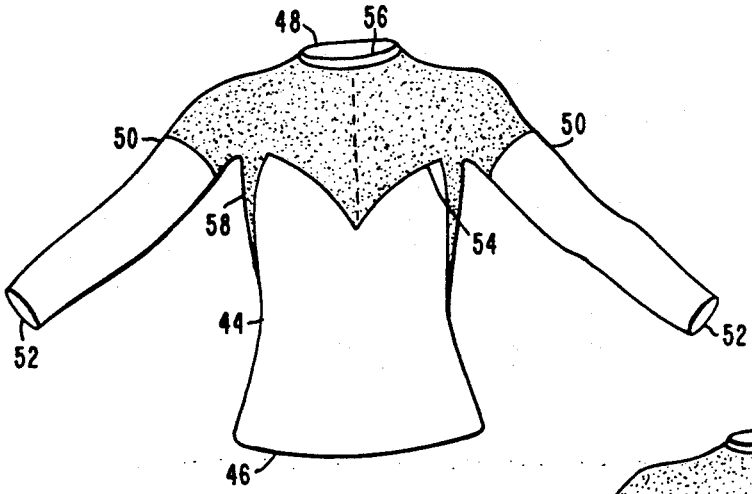
Fig. 2.
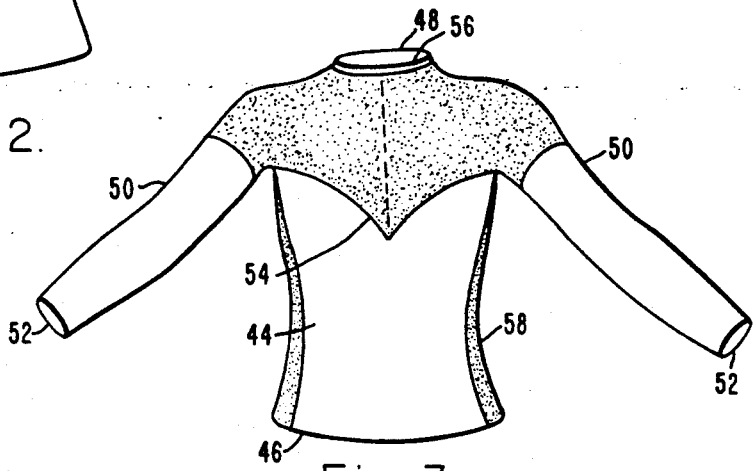
Fig. 3.
Fig. 4.
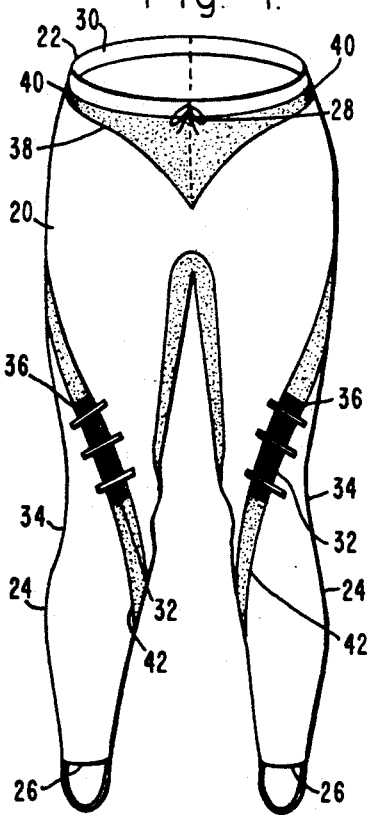
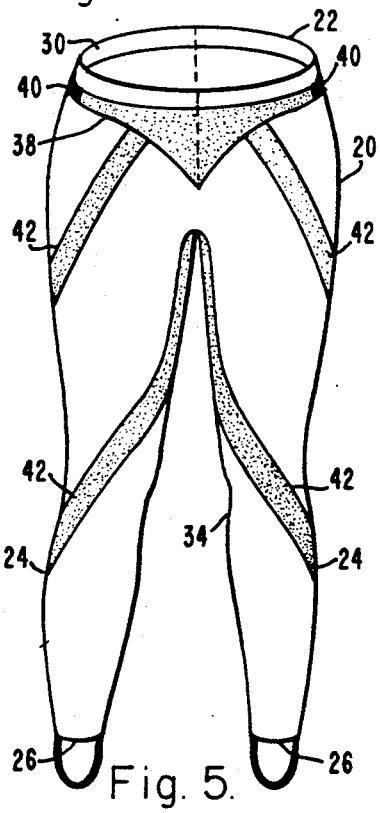
Fig. 5.

Fig. 10.
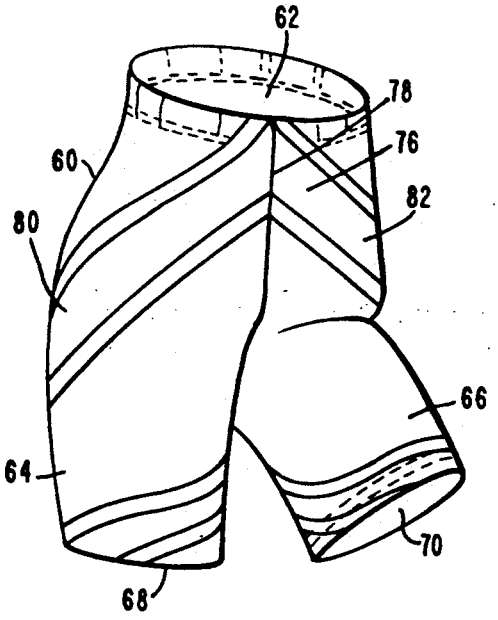
Fig. 11.
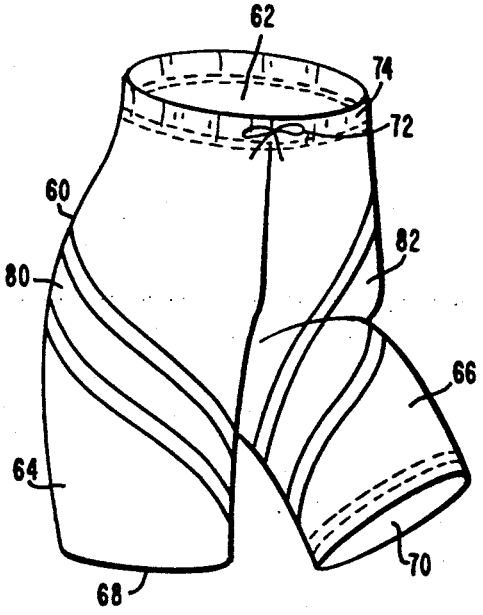
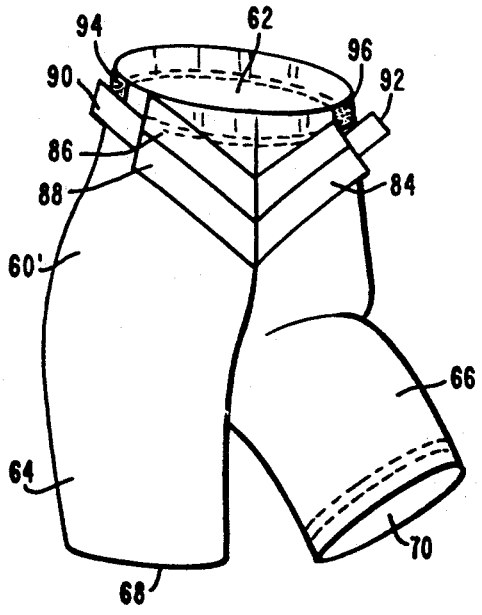
Fig. 12.
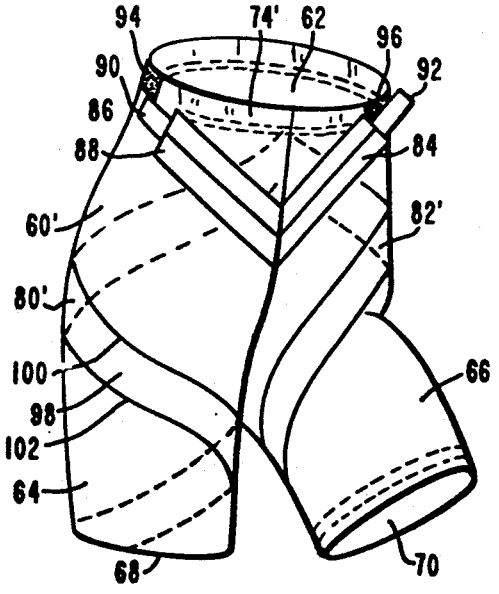
Fig. 13.

EXERCISE SUIT WITH RESILIENT REINFORCING

CROSS-REFERENCE TO RELATED APPLICATION

The present application is a continuation-in-part of application Ser. No. 07/712,459 filed Jun. 10, 1991 now U.S. Pat. No. 5,109,546.

TECHNICAL FIELD

The present invention relates to exercise suits in general, and more particularly to form-fitting pants, shorts, and pull-over tops made of stretchable material having reinforcing segments with helically wound leg and arm resistive bands attached integrally to the suit.

BACKGROUND ART

Previously, many types of exercise suits have been proposed in endeavoring to provide an effective means for increasing exertion and labor to the muscles of the human body. In some cases, the prior art has employed a single one-piece suit using elastic bands embedded between layers of the suit to provide resistance against the movement of the wearer, particularly during use of the arm and leg muscles. Others have added weights or restrictive elastic materials to the garment in one form or the other.

A search of the prior art did not disclose any patents that read directly on the claims of the instant invention; however, the following U.S. patents were considered related:

| U.S. PAT. NO. | INVENTOR | ISSUED |
|---|---|---|
| 3,759,510 | Jackson, J. W. | 18 September 1973 |
| 4,065,814 | Fox, E. N. | 3 January 1978 |
| 4,267,607 | Tino, A. | 19 May 1981 |
| 4,384,369 | Prince, L. | 24 May 1983 |
| 4,390,999 | Lawson et al. | 5 July 1983 |
| 4,607,640 | McCusker, L. H. | 26 August 1986 |
| 4,670,913 | Morell et al. | 9 June 1987 |
| 4,890,336 | Worton, B. | 2 January 1990 |
| 4,910,802 | Malloy, E. A. | 27 March 1990 |
| 4,922,551 | Anthes, G. | 8 May 1990 |

Fox U.S. Pat. No. 4,065,814

This patent is directed to a one-piece elastic body toning suit. The suit 10 comprises a shirt section 14, a waist portion 32, and a trouser section 34. Suit 10 has an outer layer 42 and an inner layer 44 formed from cotton, nylon, polyester or acrylic, and cotton, respectively. Disposed along the front and back of suit 10 between layers 42 and 44 are two elongated vertical elastic band members 48 and 58. Band members 48, 58 terminate at the bottom of the suit leg portions 36 and 37, respectively, and have affixed to their ends triangular strap members 48 and 70, respectively. Strap members 68, 70 are adapted to receive the feet of the wearer of the suit. When suit 10 is worn, band members 48, 58 are placed under tension by the downward pulling exerted by the feet of the user on strap members 68, 70, thereby creating pressure on the muscles of the body.

Tino U.S. Pat. No. 4,267,601

This patent is directed to pantyhose. The pantyhose 10 comprises a waist portion 15, pants portion 11, and a pair of connected leg portions 12. Leg portions are provided with reinforcing bands 13 and 14 in the area of the thighs to facilitate the wearer in stretching the leg sections to the legs when the pantyhose 10 are fitted.

Lawson U.S. Pat. No. 4,390,999

This patent is directed to pantyhose with body bulge control. The pantyhose comprise a girdle portion 10, an elastic waistband 11, and a pair of hosiery leg portions 12 and 13. The upper end portions of leg portions 12 and 13 are provided with elastic or SPANDEX yarn, indicated at 14, to provide a medium amount of compressive force against a wearer's upper thighs.

McCusker U.S. Pat. No. 4,607,640

This patent is directed to an athletic/industrial brassiere with protective inserts. The brassiere 11 comprises a stretchable band 12 that encircles the thoracic cage, hook end elements 13 attached to the ends of band 12, and right and left breast portions 14R and 14L, respectively. Breast portions 14R and 14L comprise outer and inner fabric layers 17A and 17B, respectively. Fabric layers 17A, 17B are stitched together in a manner that defines a thin pocket on each breast portion. Plastic inserts 21R and 21L made from high-density polyethylene are inserted into the pockets to protect the user's thoracic cage from forces of impact.

Malloy U.S. Pat. No. 4,910,802

This patent is directed to an exercise suit. The suit 10 is made of a stretchable fabric such as nylon and comprises a unitary construction including a torso portion 11 and pants 12 joined by a waist portion. Torso section 11 and pants 12 include a series of conduits for elastic bands. Referring to FIG. 1, the sleeves include upper and lower elastic bands 18*a*and 18*b*, 19*a* and 19*b*, 20*a* and 20*b*, and 21*a* and 21*b*. Lower and upper elastic bands are secured together by serrated toothbuckles 29. The elastic bands are adjustable to provide a desired pre-load or tension determining the level of exercise of a wearer of suit 10. The elastic bands on the pants 12 serve the same function as those on the torso section. However, elastic band 24, located on the waist portion, merely maintains the suit 10 at a predetermined orientation relative to the user.

For background purposes and as indicative of the art to which the invention relates, reference may be made to the remaining cited patents issued to Jackson, Price, Morell et al., Worton, and Anthes.

DISCLOSURE OF THE INVENTION

Many attempts have been made in the prior art to utilize elastic material of one kind or the other in order to offer resistance to the human body when kinetically acted upon. The use of a two-piece suit or short pants of a stretchable material with specific adjustable elastic materials has not been considered, particularly with sewn-in resistant segments or panels and resistive bands so arranged as to provide resistance to the muscles of the body during movements such as walking or running. It is therefore a primary object of the invention to provide a stretchable suit or short pants with elastic reinforcing segments and bands that are adjustable to increase or decrease the amount of resistance during various activities.

These elastic reinforcements helically wind around the lower limbs of the body to provide the greatest amount of resistive force in an anatomically correct manner, thus exercising a greater portion of the muscles while walking or running.

An important object of the invention is that the suit or short pants allows the user to tone and build muscle mass while conducting a primary exercise. Therefore the time used in exercising is maximized in the developmental process of physical activity.

Another object of the invention is directed to increasing lymph flow and vascularization in a controlled manner. The elastic bands, reinforcing segments, and collar are specifically located on the suit so that a balance may be achieved in accomplishing this desirable muscular growth amplification.

Still another object of the invention is a minimizing of low-back injuries while exercising. The suit and short pants are elastic in nature initially, and the stretchable reinforcements are positioned in areas complementary to the natural muscular orientation; thus, the strain on the lower back is basically controlled. While it may be impossible to eliminate strains to the muscles completely in exercising due to vast differences in individual strength and endurance, the invention has a controlling influence and has from its inception taken this object into consideration.

Yet another object of the invention is to allow adjustment in the amount of resistance to the legs. In the case of the suit, the segment encircling the waist and to which the ends of the leg bands are attached may be tightened or loosened by disconnecting and reconnecting each side individually using the hook-and-loop tape better known by its trademark "VELCRO." This adjustment prestresses the lower body segment around the waist and over the abdomen. Because the attachment to the pants is only in the center, the resistive force is transmitted directly to the leg bands, allowing a regulated resistive balance as selected by the user. In the case of the short pants, the low-back panel is similarly adjustable, and the resistive elongatable leg bands function similarly to those in the suit.

These and other objects and advantages of the present invention will become apparent from the subsequent detailed description of the preferred embodiment and the claims taken in conjunction with the accompanying drawings.

BRIEF DESCRIPTION OF THE DRAWINGS

FIG. 2 is a front view of the pull-over top by itself.

FIG. 3 is a rear view of the pull-over top by itself.

FIG. 4 is a front view of the pants.

FIG. 5 is a rear view of the pants.

FIG. 10 is a back view of the shorts.

FIG. 11 is a front view of the shorts.

FIG. 12 is a back view of an alternative embodiment of the shorts with a low-back panel.

FIG. 13 is a back view of the embodiment of the shorts shown in FIG. 12 with a low-back panel and back-to-front restrictive panels.

BEST MODE FOR CARRYING OUT THE INVENTION

Figure 1:
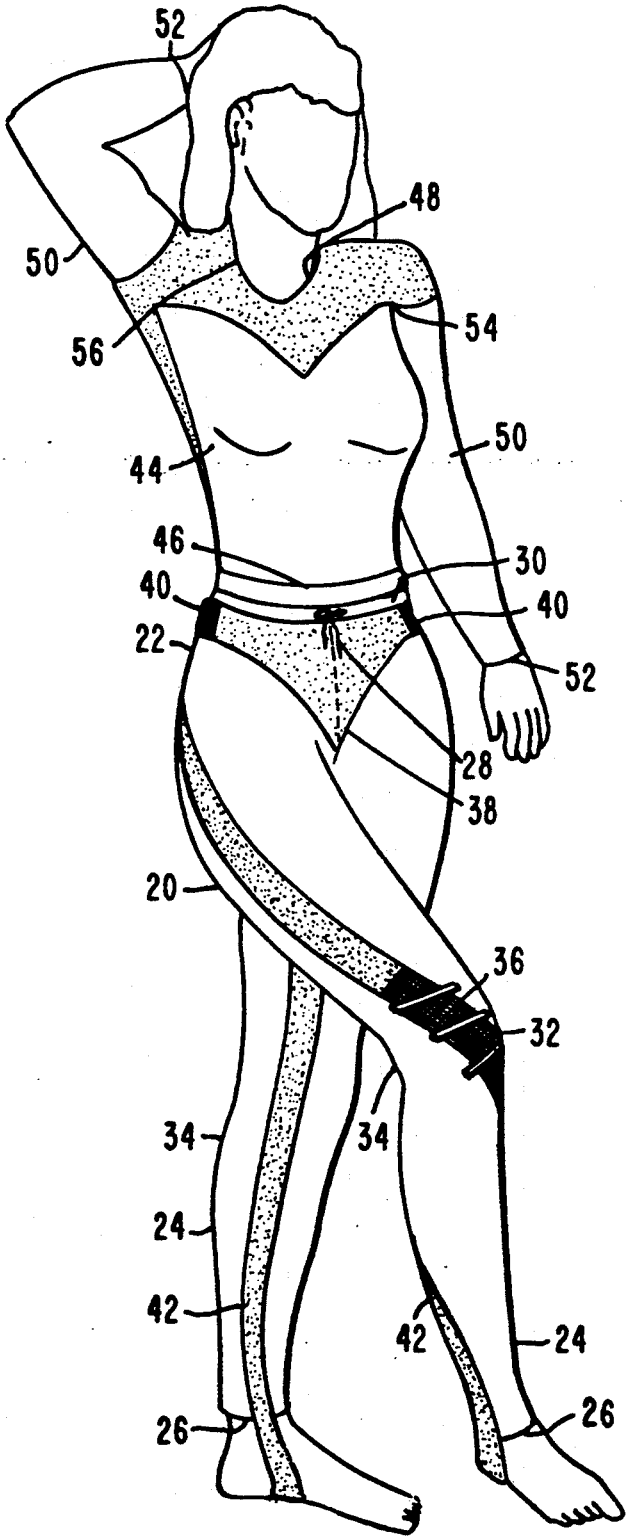
FIG. 1 is a front view of person wearing the exercise suit.

The best mode for carrying out the invention is presented in terms of a preferred embodiment. As shown in FIGS. 1 through 9, the preferred embodiment comprises a pair of stretchable form-fitting pants 20 with an open waist 22, a pair of legs 24, and an ankle opening 26 in each leg.

The pants 20 are made to fit tightly over the body and include a drawstring 28 adjacent to and parallel with the waist 22. The drawstring 28 is disposed within an overlapped encasement 30 allowing the wearer to pull the ends of the drawstring 28 tight and tie them together in a bow. While the pants 20 fit tightly, the drawstring 28 simply assures that the waist 22 does not slip down out of place in movement of the wearer during physical exercise.

The pants 20 are made of a synthetic fiber material, preferably of a polymer that contains at least 85 percent polyurethane. This material is known commonly as SPANDEX and is elastic in nature, allowing stretching with a memory that results in a return to the unstretched size. The material may be sewn together by stitching with thread, permitting the pants 20 to be made in any size and shape as with conventional nonstretching fabric.

A pair of resilient lower-body reinforcing segments 38 are juxtapositioned on the pants 20 across the front and back and between the legs 24. These reinforcing segments 38 are in a generally triangular shape with angular corners.

Figure 6:
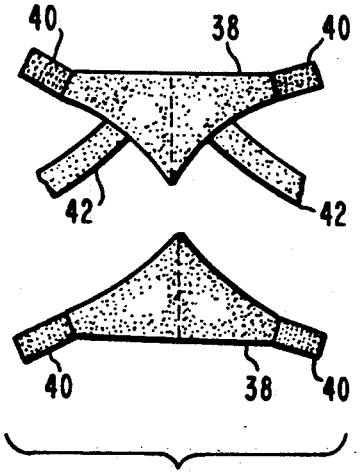
FIG. 6 is a plan view of the lower body reinforcing segments laid flat with only a small portion of the leg bands illustrated. This segment is completely removed form the invention for clarity.

FIG. 6 illustrates the reinforcing segments completely removed from the pants 20 and laid flat. The corners of the reinforcing segments contain a length of hook-and-loop tape 40 commonly known by its registrated trademark VELCRO 32 except the shape is different. The loop section is preferably attached by sewing to the rear corners of the pants and the hook section is sewn directly beneath the front side of the pants 20.

The tape 40 may be in any configuration; however, the preferred embodiment employs a rectangular shape on the front and back. This shape allows easy access to the corners when adjustment is required and sufficient area is available to make a secure attachment.

The reinforcing segments 38 are attached to the pants 20 only on the center, or middle, from the top to bottom, preferably by sewing. This method of attachment is important since it transmits the resistive force to the center of the wearer's body parallel to the backbone and equalizes the linear tension, thus eliminating unbalanced forces. Because the reinforcing segments 38 are attached to the pants 20 in the center and the corners are connected to each other, the segments remain in place even when the pants are removed.

An elongatable resistive leg band 42 spirally encircles each pants leg 24 and is linearly attached to the pants. The ends are permanently affixed to the back reinforcing segment 38 as shown in FIGS. 5 and 6. This disposition provides a loop that continues around each side of the ankle openings 26, creating a spirally wound resistance band that starts from the back of the reinforcing segment 38 and continues around the pant legs 24, over the knee, and through the crotch in a looping fashion parallel with the part of the loop near the point of origin.

Figure 7:
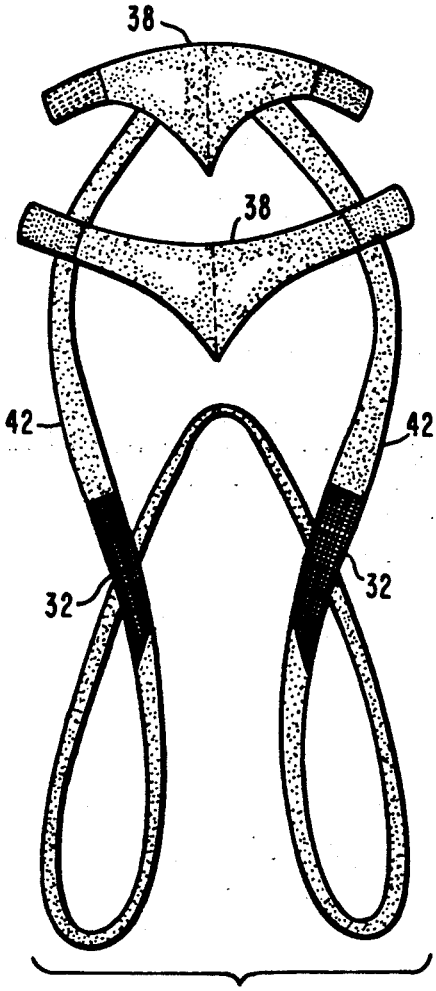
FIG. 7 is a front isometric view of the lower body segment and the leg band completely removed from the pants but oriented as they would be worn.
Figure 8:
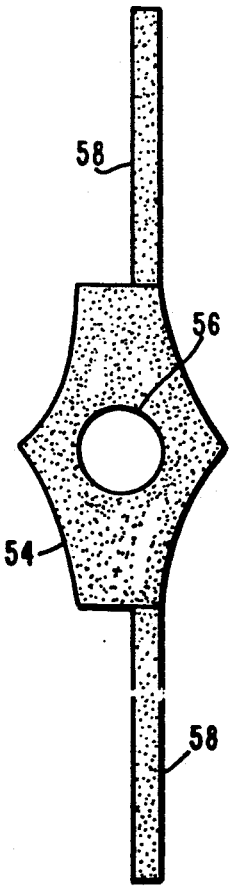
FIG. 8 is a plan view of the upper body reinforcing collar band including side bands aid flat depicting the attachment of the bands. The dashed lines represent the stitching that attaches the collar band to the pull-over top.

Since the leg band 42 is a continuous loop, a controlled amount of resistance is provided in an anatomically accurate manner. FIG. 7 depicts the band 42 attached to the reinforcing segment 38 without the pants 20 for clarity in illustrating the loop principle. The band 42 is in one piece; however, at each knee a number of pad loops 33 attached to the pants 20 over the knee are keep the pad 32 in place and hold the hook-and-loop tape tightly together for maximum tensional strength.

A stretchable, resilient reinforcing knee pad 32 is fastened below the knee area 34 of the pants, 20 allowing an adjustable bending resistance to the knee of the wearer. The pads 32 are adjustable in length which permits altering the amount of resistance. The pads are permanently attached to the lower portion by sewing with thread while the upper portion employs hook-and-loop tape 36 the same as used in the corners of the reinforcing segments 40.

Figure 9:
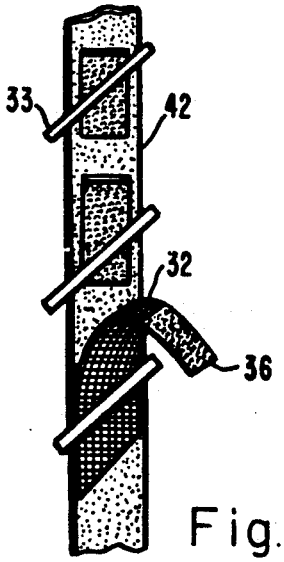
FIG. 9 is a fragmentary view of the leg band with the knee pad turned down to illustrate its adjustability.

The loop tape is sewn above the knees 34 onto the pants 20 and the hook tape is attached to the inside of the knee pad 32. This arrangement allows the pad to be pulled taut and fastened to the knee or loosely connected, permitting adjustment to any desired resistance. FIG. 9 depicts the pad 32 disconnected at one corner, illustrating the adjustable nature of the attachment method.

A stretchable form-fitting pull-over top 44 completes the basic suit, covering the top half of the wearer's body. The top 44 has an open waist 46 and an open neck 48 as well as a pair of sleeves 50 with wrist openings 52. The pull-over top 44 is illustrated in FIG. 1 on a person and in FIGS. 2 and 3 by itself.

A resilient upper-body reinforcing collar 54 is attached to the pull-over top 44 in the center only, in a manner similar to the lower-body reinforcing segment 38. Collar 54 is generally diamond-shaped with two truncated vertices and has a circular opening 56 in the center for the wearer's head. The arrangement of collar 54 is such that the two truncated ends of the diamond shape are over the wearer's shoulders to form short sleeves and are attached in the center of the front an back to create a resilient foundation.

A pair of elongatable resistive side bands 58 ar attached at their upper ends to the collar 54. The lower ends are attached likewise to the waist opening 46 to provide a resistive restraint upon the wearer whenever the body is moved in any direction. The wearer's back and shoulders are jointly restrained by the collar 54 assisted by the side bands 58.

The top 44 is made of the same material as the pants 20. The leg and side bands 42 and 58 are made of latex rubber strips having a width from 4 inches (10.2 cm) to 6 inches (15.2 cm) wide. While any kind of latex rubber strips may be used, it has been found that the material known by its trademark THERA-BAND has proven optimum in the application. The reinforcing segment 38 and collar 54 preferably are made of heavy 75 percent elastic or so-called SUPER-SPANDEX.

In use, the wearer pulls on the pants 20 and top 44 much as in donning conventional exercise suits. The waist drawstring 28 is tied and the adjustment is made on the sides over the hips by detaching and reattaching the hook-and-loop tape 40 to create the desired resistance from the reinforcing segment 38 and leg bands 42. The knee pads 32 are likewise adjusted and the person conducting the desired exercise can make readjustments as desired.

As shown in FIGS. 10–13, the invention further encompasses exercise short pants 60 with resilient reinforcement for increasing resistance to a wearer's muscles. Referring to FIGS. 10 and 11, short pants 60 comprise a stretchable form-fitting pair of shorts having an open waist 62 and a pair of short legs 64, 66 terminating at openings 68 and 70, respectively. The short pants 60 are made to fit snugly over the body and include a drawstring 72 adjacent to and parallel with the perimeter of the open waist 62. The drawstring 72 is disposed within an overlapping encasement 74. The wearer of exercise short pants 60 can pull the ends of drawstring 72 tight and tie them together into a bow to assure that short pants 60 do not move downward out of place during the movements associated with physical exercise. Alternatively, overlapping encasement 74 can enclose an elastic waistband to keep exercise shorts 60 in place around the waist of the wearer.

Exercise short pants 60 are preferably made of a synthetic material such as a polymer containing at least 85 percent polyurethane. This type of material, commonly known as SPANDEX, is elastic and can be stretched beyond its normal shape but returns to the normal shape when stretching forces are removed. Short pants 60 can be made in any size and shape by conventional sewing techniques so as to fit a wide variety of wearers.

An elongatable resistive band 76 comprises first and second strips forming an inverted V-shape which is fastened to short pants 60 along a back midline 78 near waist 62. First and second strips 80 and 82 of band 76 descend at acute angles from midline 78 and spirally encircle each short pants leg 64 and 66. Strips 80 and 82 are linearly attached to short pants 60 and terminate at leg openings 68 and 70, respectively. Strips 80 and 82 each comprise a center portion of SUPER SPANDEX with adjoining outer portions of elastic waistband As shown in FIG. 11, strips 80 and 82 of band 76 spiral around the thigh sections of the wearer below the groin area. Band 76 provides a controlled amount of resistance to motion of the wearer in an anatomically correct manner.

An alternative embodiment 60' depicted in FIGS. 12 and 13 comprises a pair of exercise short pants 60 to which has been added a low-back panel 84. Low-back panel 84 comprises a V-shape made of two strips of three-inch wide elastic material. The two strips 86 and 88 are stitched together along their length and twisted and stitched to form the V-shape. Attachment of low-back panel 84 is made by means of elastic to the vertical midline of the back of short pants 60.

First and second loop-and-hook stays 90 and 92 are attached to the free ends of the two arms of the "V" forming low-back panel 84. Mating hook-and-loop patches 94 and 96 are sewn to the waistband of exercise short pants 60' at the sides thereof. Patches 94 and 96 have lengths along the circumference at the sides of the waistband to allow various degrees of tension in low-back panel 84 depending upon where stays 90 and 92 are fastened.

FIG. 13 shows exercise short pants 60' with elongatable resistive bands 80' and 82' starting at the vertical midline of the front of the garment and spiralling downward and around legs 64 and 66, respectively, around the thighs of the wearer below the buttocks and terminating at leg openings 68 and 70, respectively. As before, bands 80' and 82' comprise a central strip 98 of SUPER SPANDEX material flanked by outer strips 100 and 102 of one-inch wide elastic waistband material.

As before, embodiment 60' can additionally comprise a drawstring 72' (not shown) inside an overlapping encasement 74' to provide additional assurance that short pants 60' do not slip down from the waist of the wearer during exercise.

To use exercise short pants 60', the wearer pulls them on as in donning a conventional snugly fitting garment. Waist drawstring 74' is tied and hoop-and-loop stays 90 and 92 are adjusted in position on mating patches 94 and 96 to create the desired amount of resistance from low-back panel 84.

While the invention has been described in complete detail and pictorially shown in the accompanying drawings, it is not to be limited to such details since many changes and modifications may be made in the invention without departing from the spirit and the scope thereof. Hence, the invention covers any and all modifications and forms which may come within the language and scope of the appended claims.

I claim:

1. Exercise short pants with resilient reinforcement for increasing resistance to a wearer's muscles comprising:

a pair of stretchable form-fitting short pants having an open waist and a pair of short legs each containing an opening at an end thereof;

first and second elongatable resistive bands fastened to said short pants at a back vertical midline thereof adjacent said open waist in a depending inverted V-shape, each said elongatable resistive band spirally encircling each leg and affixed thereto, each said band having a common beginning at said midline and running diagonally downward around a back part of a wearer's thigh and terminating at said opening of said leg after encircling a front portion of said leg above a wearer's knee;

wherein said first and second bands form a resistive constraint upon the wearer's body between the waist and knees for muscular toning and exercise.

2. The exercise short pants as recited in claim 1, wherein each said band comprises a center strip having a first width and first and second outer strips adjacent thereto each having a second width.

3. The exercise short pants of claim 2, wherein said center strip comprises an elastic material and said first width is about 4 to 6 inches, and wherein said outer strips comprise latex and said second width is approximately 1 inch.

4. Exercise short pants with resilient reinforcement for increasing resistance to a wearer's muscles comprising:

a pair of stretchable form-fitting short pants having an open waist and a pair of short legs each containing an opening at an end thereof;

first and second elongatable resistive bands fastened to said short pants at a front vertical midline thereof adjacent said open waist in a depending inverted V-shape, each said elongatable resistive band spirally encircling each leg and affixed thereto, each said band having a common beginning at said midline and running diagonally downward around a back part of a wearer's thigh and terminating at said opening of said leg after encircling a front portion of said leg above a wearer's knee;

wherein said first and second bands form a resistive constraint upon the wearer's body between the waist and knees for muscular toning and exercise.

5. The exercise short pants as recited in claim 1, wherein each said band comprises a center strip having a first width and first and second outer strips adjacent thereto each having a second width.

6. The exercise short pants of claim 2, wherein said center strip comprises an elastic material and said first width is about 4 to 6 inches, and wherein said outer strips comprise latex and said second width is approximately 1 inch.

7. The exercise short pants of claim 1 further comprising:

an elastic low-back panel having a generally V-shaped outline, attached to a vertical midline of a back of said short pants and having first and second arms slanting upwardly toward said waist, each said arm having a free end to which a hook-and-loop stay is attached; and first and second hook-and-loop patches attached to said waist at opposite sides thereof at positions reachable by said free ends of said first and second arms, respectively;

wherein said stays and said patches are of mating hook-and-loop materials and elastic tension in each of said arms may be adjusted by adjusting the positions of said stays on said patches.

8. The exercise short pants of claim 4 wherein said low-back panel comprises two adjacent three-inch wide strips of elastic material sewn together along their lengths and folded over to form a V-shape.

9. The exercise short pants of claim 5 wherein said stretchable form-fitting short pants comprise a synthetic fiber material of a polymer containing at least 85 percent polyurethane.

10. The exercise short pants as recited in claim 4 further comprising a drawstring adjacent and parallel with the open waist disposed within an overlapping encasement permitting a wearer to draw said drawstring tight to hold said shorts in a comfortable position.

* * * * *